US005375581A

United States Patent [19]

Müller-Alander et al.

[11] Patent Number: 5,375,581

[45] Date of Patent: Dec. 27, 1994

[54] INTERNAL COMBUSTION ENGINE WITH SUPERCHARGER OF POSITIVE DISPLACEMENT DESIGN

[76] Inventors: Gerd Müller-Alander, Nördliche Auffahrtsallee 50, 8000 München 19; Hans Hofmann, Chopinstrasse 30, 8000 München 60, both of Germany

[21] Appl. No.: 640,401

[22] PCT Filed: May 19, 1989

[86] PCT No.: PCT/EP89/00554

§ 371 Date: Jan. 22, 1991

§ 102(e) Date: Jan. 22, 1991

[87] PCT Pub. No.: WO89/11584

PCT Pub. Date: Nov. 30, 1989

[30] Foreign Application Priority Data

May 20, 1988 [DE] Germany ..... 3817318

[51] Int. Cl.[5] ..... F02B 33/00

[52] U.S. Cl. ..... 123/559.1; 123/65 B

[58] Field of Search ..... 123/559.1, 65 B; 418/172, 173

[56] References Cited

U.S. PATENT DOCUMENTS 1,869,787 8/1932 Trumble .
4,041,837 8/1977 Weidlich .

FOREIGN PATENT DOCUMENTS 2222500 11/1973 Germany .
3000145 7/1981 Germany .
3432915 12/1985 Germany .
403245 12/1933 United Kingdom ..... 123/559.1

*Primary Examiner*—Michael Koczo

[57] ABSTRACT

In an internal combustion engine with a positive displacement charger having a charger housing adjacent to the engine cylinder(s), the gas exchange control element for the combustion chamber inlet is a functional part of the charger, preferably designed as a rotary piston charger. An internal combustion engine comprising at least one set of three cylinders having a combustion space is provided with an outlet gap at its lower end. The outlet gap is controlled by a stroke piston. There is at least one rotary piston charger in constant driving connection with a crank shaft. The charger has an outlet opening forming an inlet opening of one combustion space. The opening is capable of being closed off by a gas exchange control element that is separate from the stroke piston. There is a charger housing having a first rotor formed as a cylinder and having an outer shell and openings forming the gas exchange control element as a rotary valve and, after completion of a charger exchange, providing a stationary envelope surface of at least one of said combustion spaces. The charger housing is a part of a head of a cylinder and the first rotor has three engaging pieces evenly spaced on the circumference of the outer shell.

1 Claim, 8 Drawing Sheets

INTERNAL COMBUSTION ENGINE WITH SUPERCHARGER OF POSITIVE DISPLACEMENT DESIGN

FIELD OF THE INVENTION

The invention concerns an internal combustion engine with at least one charger of positive displacement design.

STATE OF THE ART

In an internal combustion machine of this type, known from DE-PS 416 222, which is formed as a two-stroke internal combustion engine with combustion chamber inlet at the cylinder head side and combustion chamber outlet at the cylinder foot side, a scavenging and charging pump cylinder is arranged above the engine cylinder. Between the two cylinders there is a common front wall, serving as a partition wall, which has a connection opening, through which the compression space of the scavenging and charging pump cylinder and the combustion space of the engine cylinder are connected with each other. Arranged in the connection opening is a self-activated valve, which is caused to close by a spiral spring and by the gas pressure in the combustion space. The pistons in the engine cylinder and in the pump cylinder work in essentially opposite strokes with a certain advance of the pump piston. A gear arranged outside the cylinder activates the pump piston from the engine crank shaft. The known internal combustion engine is expensive, has poor efficiency, and is not suitable for higher speeds of rotation and an operation satisfying modern demands with low emission of pollutants and good efficiency.

In another known internal combustion engine, a charging is provided by mechanically driven displacement chargers, which are fashioned as rotary piston chargers of Roots design, either in the case of two-stroke engines with combustion chamber inlet at the cylinder head or cylinder foot side of the combustion chamber or in the case of four-stroke engines (e.g., DE-PS 546 040, DE-PS 673 526, DE-AS 10 61 127, DE-AS 11 45 855). In addition to rotary piston chargers of the Roots design, rotary piston chargers are known as displacement chargers that are mechanically driven by the crankshaft of the internal combustion engine. These are fashioned as parallel and inner-axis trochoid rotary piston machines with inner and outer rotor, controlling the inflow and outflow openings of the charger itself (DE-OS 24 56 252, DE-PS 34 32 915, DE-Zeitschrift MTZ 1960, pages 33 to 45, DE-Zeitschrift MTZ 1986, pages 284, 285), or as parallel and outer-axis rotary piston machines with piston rotor and at least one shutting rotor (DE-OS 22 22 500, DE-OS 32 19 793, DE-OS 33 13 592, DE-Zeitschrift Mot 1983, Volume 1, pages 68 to 71). In the familiar internal combustion engines, the rotary piston charger is always arranged at a distance from the combustion space. The gas inlet into the combustion space is controlled either by the engine piston moving over the inlet slots or by separate gas exchange control elements, such as lift valves or cylindrical rotary valves. In U.S. Pat. No. 4,041,837 a Wankel device is provided for the charging with fresh gas, which is connected to the combustion space via long channels without the interposition of a gas exchange control element. Accordingly, it cannot be separated from the working space during the high pressure process, so that its inner parts are heated by the combustion gas. This has negative influence on the filling ratio, performance, and fuel consumption. Furthermore, a strong quench effect occurs at the walls of the connection channel, resulting in high emissions of hydrocarbons.

SUMMARY OF THE INVENTION

The primary purpose of the invention is to create an internal combustion engine of the type mentioned at the outset, which allows a good filling of the combustion space in a compact and simple layout with minor construction expense.

The solution to this problem is an internal combustion engine with at least one charger of positive displacement design. The charger is in constant driving connection with the engine crank shaft and has a charger housing that abuts on the engine cylinder, whose outlet opening forms the combustion space inlet opening. The combustion space inlet opening can be closed off by a gas exchange control element that is separate from the engine piston. The charger has at least one swivel-mounted part in the charger housing that stands in constant mechanical drive connection with the engine crank shaft and forms the gas exchange control element. With structural unification of engine cylinder and charger, this achieves a combustion chamber inlet control that can be adjusted at will, allowing the machine to operate at higher rotational speeds. Furthermore, high performance and high torque can be achieved with good efficiency. A particularly simple engine design results when a functional element of the charger takes on the function of the charge exchange control element, in addition to its function as a part of the charger.

If the charger is designed as a rotary piston charger, because of its arrangement in immediate proximity to the combustion space, it can lead into the combustion space without the interposition of a pipeline or a collecting space, so that no special gas exchange control elements are needed if a functional element of the rotary piston charger is fashioned as the control element. This achieves an extremely simple engine design.

According to the invention, displacement chargers of different design can be employed. It is especially advantageous to use a rotary piston charger fashioned as a parallel and inner-axis rotary piston machine having gearlike rotary pistons arranged eccentrically with respect to each other. The inner rotary piston forms an inner rotor with n inner rotor engagement pieces, and the outer rotary piston forms an outer rotor, cylindrical on the outside, with $n+1$ radially outwardly open compression chambers between the outer rotor engagement pieces, and this forms the gas exchange control element.

The invention is suitable for both two-stroke and four-stoke internal combustion engines, regardless of the number of combustion chambers. In the case of an engine with one combustion chamber, each rotary piston charger-compression chamber empties into this combustion chamber. For this, the speed transmission between the engine crank shaft and the outer or shutting rotor of the rotary piston charger in a two-stroke engine should be set equal to the number of compression chambers and in a four-stroke engine it should be equal to twice the number of compression chambers. In the case of a multiple cylinder engine, in which the cylinders are arranged in a row, in the interest of construction size, construction expense, and utilization of the charger speed potential, it is recommended not to have a special charger for each cylinder, but rather one rotary piston charger matched up with a number of successively adjacent cylinders and the compression chambers each matched up with only one particular cylinder, the number of compression chambers being equal to the number of engine cylinders. For example, for a two-cylinder in-line motor, one should use a rotary piston charger with two compression chambers, for a three cylinder in-line motor a rotary piston charger with three compression chambers. In an arrangement of this kind, the speed of the outer or shutting rotor of the rotary piston charger in a two-stroke engine is equal to the speed of the engine crank shaft and in a four-stroke engine it is half as large as the speed of the engine crank shaft. In Boxer and V-engines with several rows of cylinders, it is more advisable to provide a separate rotary piston charger for each row of cylinders. In the case of a larger number of cylinders arranged in a row, two or more rotary piston chargers may be arranged one after the other in order to lessen the overflow losses and the deflection of the rotor.

In a multicylinder engine of in-line design, the rotary piston charger extends in the axial direction, preferably at least approximately over the entire length of the row of cylinders with which the rotary piston charger is matched up. This achieves a good cylinder filling at modest construction expense.

When used in a four-stroke internal combustion engine, the outer or shutting rotor of the rotary piston charger can also form the gas exchange control element for the combustion space outlet. Such a configuration achieves an especially simple engine construction.

BRIEF DESCRIPTION OF THE DRAWINGS

The drawings schematically represent configuration examples of the invention, namely.

DESCRIPTION OF THE PREFERRED EMBODIMENTS

The internal combustion engines of FIG. 1 through 8 show conventional internal combustion engine housings, not configured as crankcase scavenging pump housing, with engine cylinders, and conventional crank drives with crank shafts and connecting rods and lifting pistons. In each cylinder head there is arranged a rotary piston charger, which is used to supply gas and at the same time controls the gas inlet into the combustion space.

Figure 1:
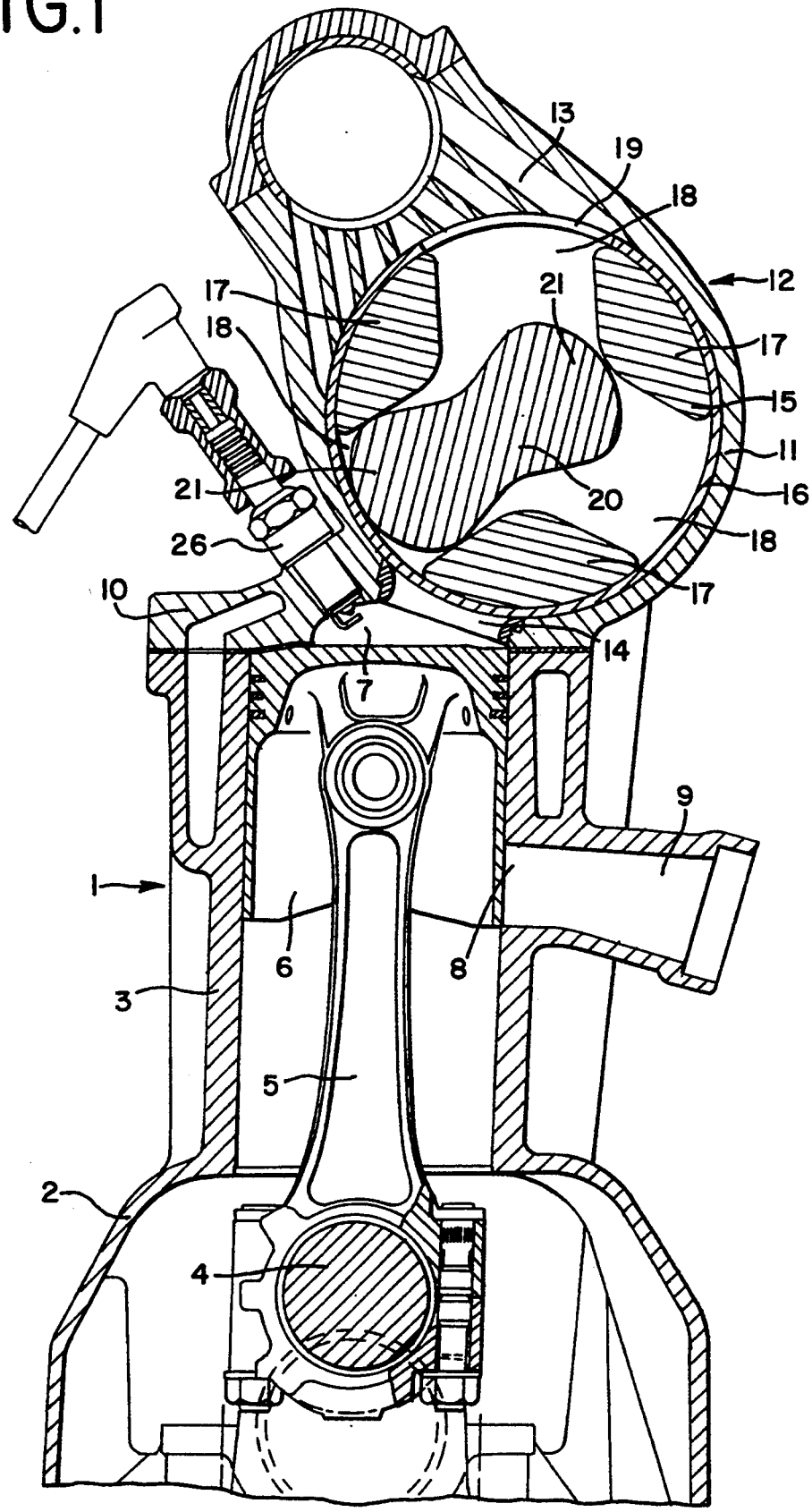
FIG. 1 a three-cylinder two-stroke internal combustion engine in cross section.
Figure 2:
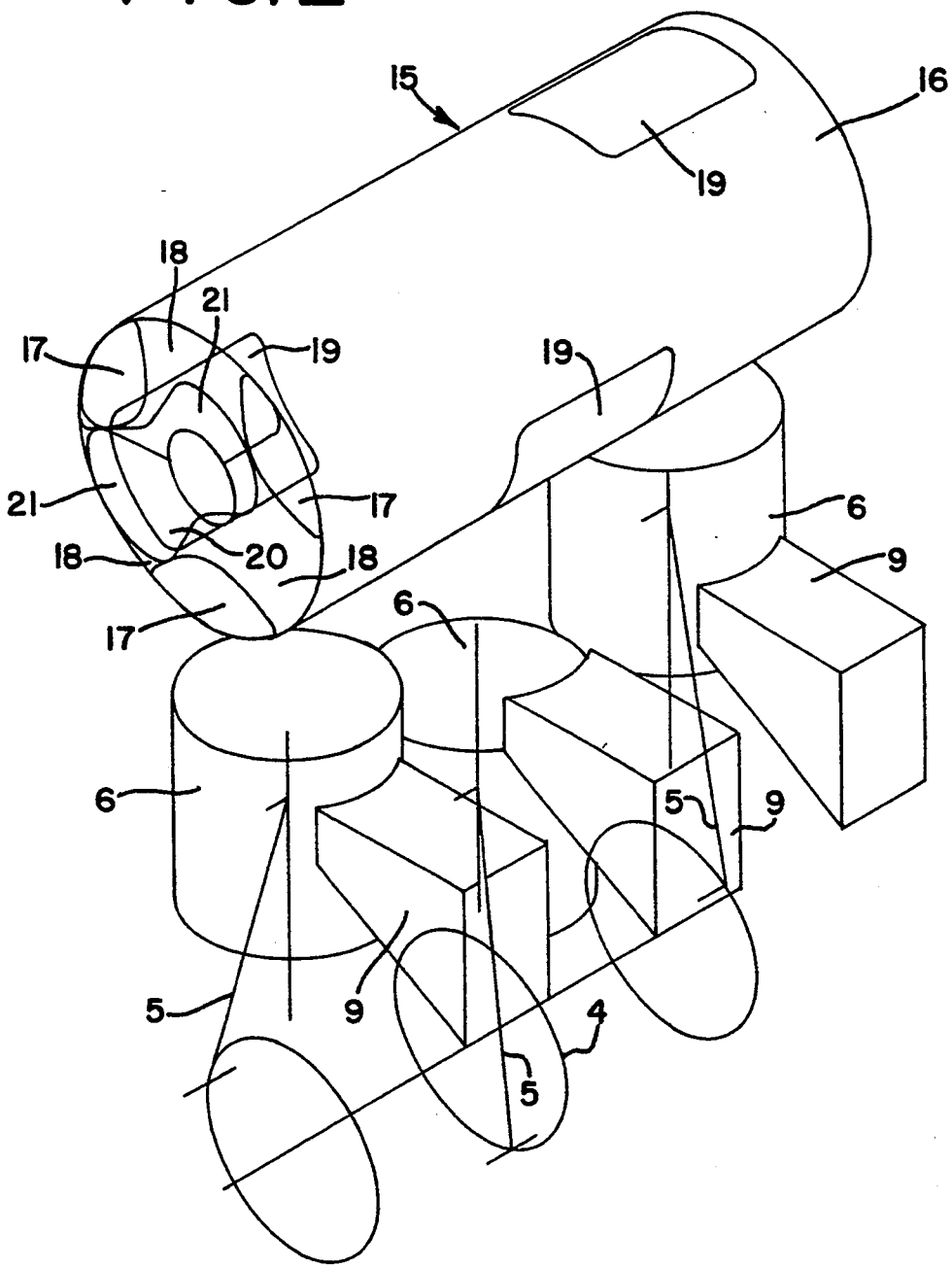
FIG. 2 the engine of FIG. 1 in oblique view.
Figure 3:
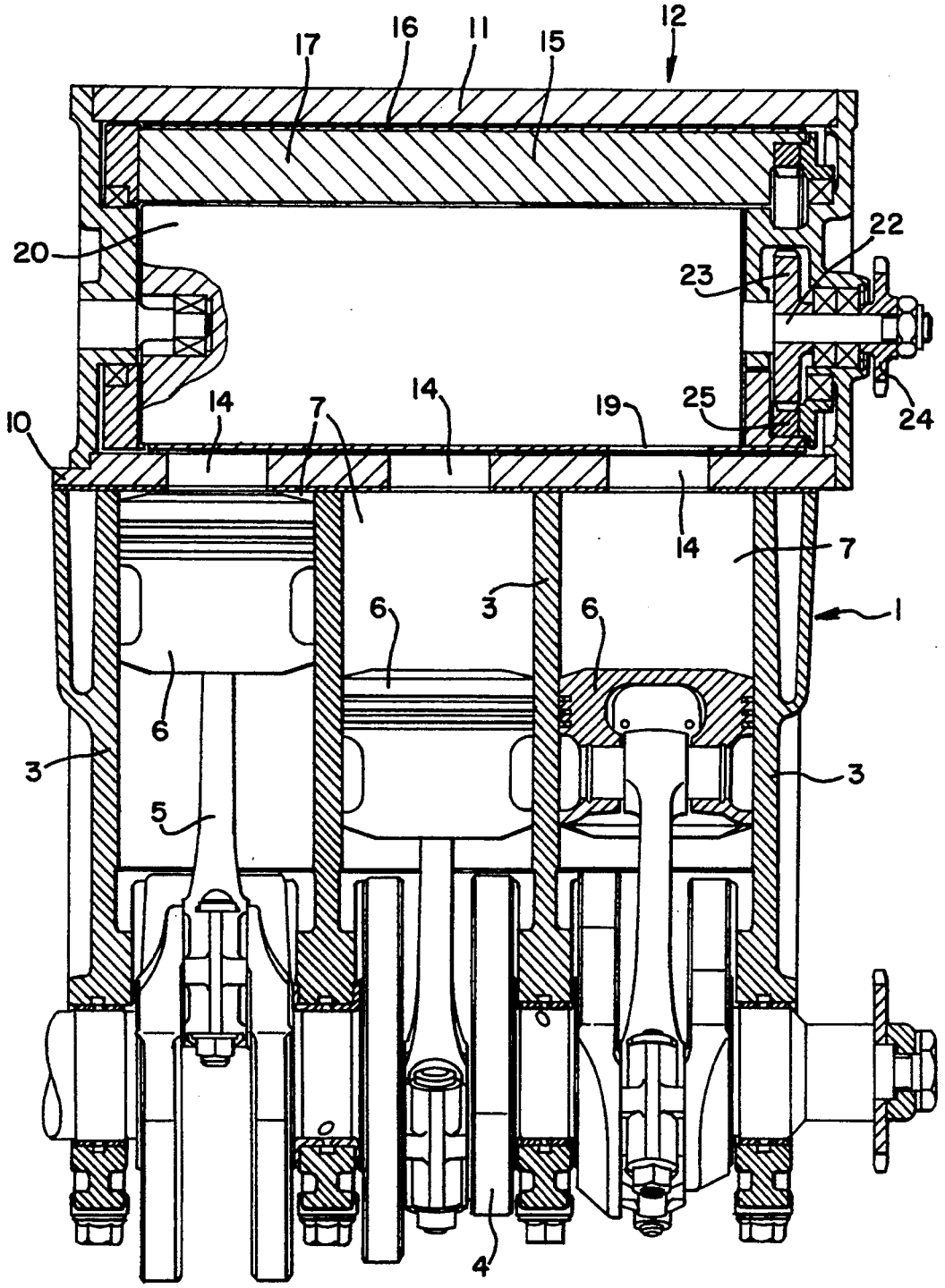
FIG. 3 the engine of FIGS. 1 and 2 in lengthwise section.

In the embodiments shown in FIG. 1 through 3, a two-stroke internal combustion engine 1 has an engine housing 2 with three water-cooled engine cylinders 3 in a row, a crank shaft 4, connecting rod 5, and lifting piston 6. The engine cylinders 3 at the lower end of the combustion chamber 7 are provided with an outlet gap 8 controlled by the lifting piston 6 and lateral exhaust channels 9 extending at least approximately transverse to the axis of the engine cylinder.

On the engine cylinders 3 there is arranged a cylinder head 10, which is connected to the cooling water circuit of the engine cylinder 3. The cylinder head 10 forms the fixed housing 11 of a common rotary piston charger 12 for all three engine cylinders 3, extending above all three engine cylinders 3 in the direction of their row arrangement. In the casing wall of the charger housing 11 there is provided an at least approximately radial charger inlet opening 13 (FIG. 1) at the side basically turned away from the engine cylinders 3, extending for approximately the entire length of the charger housing 11. The charger inlet opening 13 is connected at its inflow end to a fresh gas channel, extending in the lengthwise direction of the charger, in which is arranged a control sleeve that can swivel about the lengthwise axis of the channel. This has a radial window and is used to regulate the filling. Furthermore, in the casing wall of the charger housing 11 in the region turned toward the engine cylinders 3 there are charger outlet openings 14 which emerge into the combustion chamber 7. Within the charger housing 11 there are two gearlike rotary pistons, arranged eccentrically with respect to each other, which can revolve in the same direction, but with different angular velocities. One of the two rotary pistons is cylindrically shaped on the outside and forms an outer rotor 15 with an outer rotor casing 16 and three outer rotor engagement pieces 17, uniformly distributed about the periphery, between which three identical compression chambers 18 are formed. These extend over the entire length of the outer rotor 15 without transverse bulkheads and are directed radially inward over their entire length. On the outside, however, they are for the most part enclosed by the outer rotor casing 16. The three compression chambers 18, whose volume is adjusted to that of the combustion chamber 7, are each assigned to one of the three engine cylinders 3 and are only open radially outward through a window 19 in the outer rotor casing 16 in the region of their assigned cylinder. The three windows 19 are accordingly arranged at a distance from each other in the axial direction of the rotary piston charger 12 and with a 120 degree spacing in the peripheral direction. In the axial direction of the rotary piston charger 12 the windows 19 each have a length that is at least approximately equal to the clearance of the charger outlet openings 14. The other of the two rotary pistons is arranged in the outer rotor 15 and forms an inner rotor 20 with two inner rotor engagement pieces 21. These can mesh with the compression chambers 18 and are dimensioned such that their outside in the outermost position, represented in FIG. 1, extends as far as a narrow slit on the inside of the outer rotor casing 16. The inner rotor 20 is provided with an added shaft 22, which carries, near the inner rotor 20, a gear 23 with outer toothing and, at its outer free end, a driving gear 24, also with outer toothing. The gear 23 meshes with a gear rim 25 with inner toothing, which is secured to the outer rotor 15. The driving gear 24 is connected to the crank shaft 4 of the internal combustion engine 1 across a chain, not shown. In addition to the rotary piston charger 12, the cylinder head 10 carries three spark plugs 26, extending into the combustion chambers 7.

When the engine 1 is in operation, the rotary piston charger 12 is actuated by the crank shaft 4 via the driving gear 24 in such a way that the crank shaft 4 and the outer rotor 15 of the rotary piston charger 12 revolve at the same number of revolutions. The fresh gas (which may be air or a fuel-air mixture) flowing into the rotary piston charger 12 through the charger inlet opening 13 in the radial direction, transverse to the axis of the rotary piston, enters the assigned compression chamber 18 through the window 19 in the outer rotor casing 16 in the inflow position, is compressed in the rotary piston charger 12, and is forced into the combustion spaces 7 through the charger outlet openings 14, which are also the inlet openings of the combustion space.

The outer rotor 15 functions as control element for the inlet opening of the combustion space for each of the three engine cylinders 3. During the last part of the compression stroke and during the working stroke, the outer rotor casing 16 closes off the charger outlet opening 14. At the end of the descending motion of the lifting piston 6 and at the beginning of its ascending motion, i.e., while the burned gases are escaping from the engine cylinder 3 through the outlet slits 8 and the exhaust channel 9, the compression chamber 18 that is assigned to this engine cylinder 3 is connected with the combustion space 7 through its window 19 and the corresponding charger outlet opening 14 and allows fresh gas to flow into the combustion space 7 at its end near the cylinder head. A good gas exchange in the engine cylinder 3 is achieved through this uniflow scavenging. As the lifting piston 6 continues to move upward, more fresh gas flows into the combustion space 7, in which after the closing of the outlet slits 8 during an additional scavenging phase the pressure of the fresh gas rises to a value that is considerably more than the ambient pressure. The outer rotor casing 16 closes off the charger outlet opening 14 at the opportune time, so that the gas is further compressed and ignited and a new working stroke may ensue.

If air, instead of a fuel-air mixture, is supplied to the rotary piston charger 12, the fuel may be injected into the rotary piston charger 12. For this, a fuel injection valve will suffice, being arranged at the front end of the rotary piston charger 12, and travelling across the front end of the compression chambers 18. However, it is also possible to provide separate fuel injection valves for each engine cylinder 3 in radial arrangement, each injecting into the compression chambers 18 through the corresponding window 19. A direct injection into the combustion space 7 is also possible.

In contrast with the above described embodiment, the gas may be brought into the rotary piston charger in the axial direction. For this, there may be a charger inlet opening in the front wall of the charger housing, occupying a sector of the front end, as shown in FIG. 2 at the left side of the charger. With a flow of this type, it is possible to achieve an almost uniform gas flow upstream of the rotary piston charger.

In a single-cylinder two-stroke internal combustion engine, again, it is possible to employ a rotary piston charger with several compression chambers distributed in the peripheral direction. Between the crank shaft and the rotary piston of the charger there should be a fixed rotary speed transmission ratio, so that in successive intake strokes the compression chambers of the rotary piston charger are successively connected with the combustion space through the charger outlet opening. For example, if a rotary piston charger with three compression chambers is employed, a speed transmission ratio of 3:1 should be adjusted between the crank shaft and the outer rotor of the rotary piston charger. However, it is also possible to use a rotary piston charger with a different number of compression chambers. If a rotary piston charger with two compression chambers is employed, the speed transmission ratio between the crank shaft and the outer rotor must be 2:1. If a rotary piston charger with four compression chambers is employed, the speed transmission ratio between the crank shaft and the outer rotor of the rotary piston charger must be 4:1. In such kind of internal combustion engines, the charger inlet opening may also be either kidney-shaped at the front end or radial in the casing wall of the charger housing.

Figure 4:
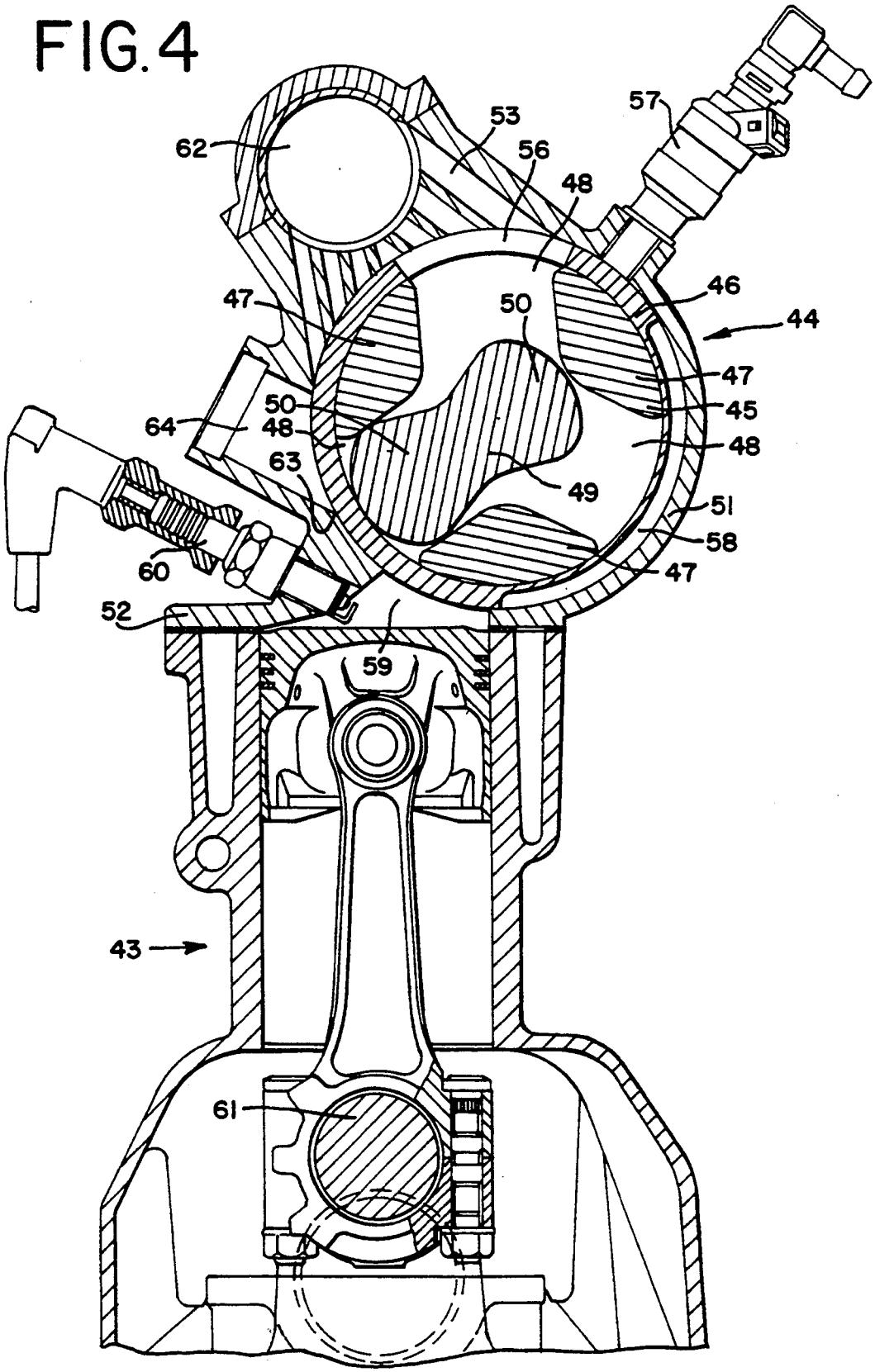
FIG. 4 a three-cylinder four-stroke internal combustion engine in cross section, FIG. 5 the engine of FIG. 4 in oblique view, FIG. 6 another four-stroke internal combustion engine in a cross section, FIG. 7 another four-stroke internal combustion engine in a cross section, and FIG. 8 another two-stroke internal combustion engine in a cross-section.
Figure 5:
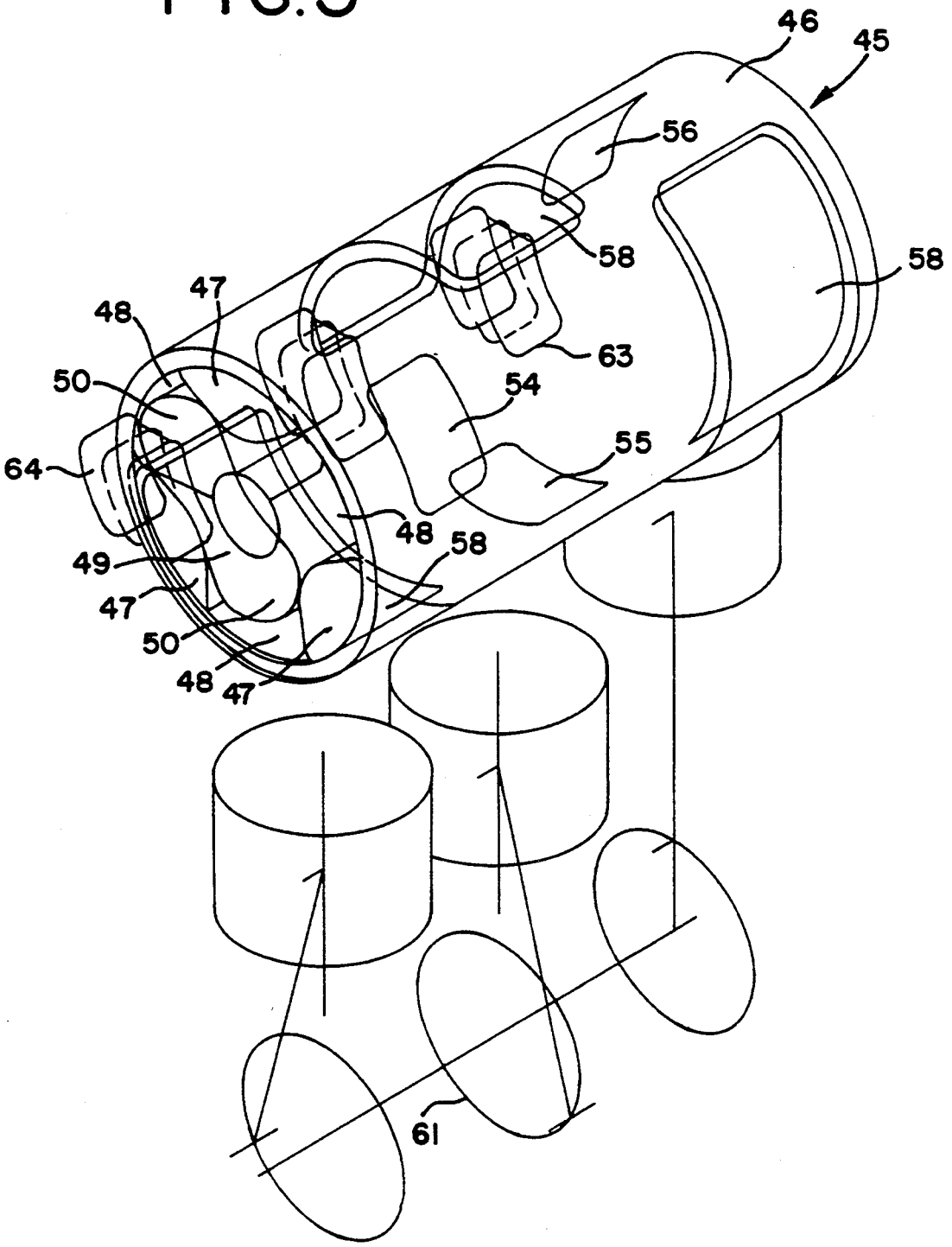

In FIG. 4 and 5, a common rotary piston charger 44 is used in a four-stroke engine 43 for all three engine cylinders arranged in a row. The rotary piston charger 44 has an outer rotor 45 with an outer rotor casing 46 and three outer rotor engagement pieces 47, uniformly arranged about the periphery, corresponding to three identical compression chambers 48. In the outer rotor 45, arranged eccentric to it, is an inner rotor 49 with two inner rotor engagement pieces 50. The outer rotor 45 and the inner rotor 49 extend in the fixed charger housing 51, which is a part of the cylinder head 52 and has, on the side turned away from the engine cylinder, at least one approximately radial charger inlet opening 53, on top of the engine cylinder and over the entire extent of the three engine cylinders in the direction of their row arrangement. The three compression chambers 48 are each assigned to one of the three engine cylinders and open radially outward in the region of the assigned cylinder through a window 54, 55, 56 in the outer rotor casing 46. The windows 54, 55, 56 are accordingly arranged with a spacing from each other in the axial direction of the rotary piston charger 44 and with a 120 degrees offset from each other in the peripheral direction. In the axial direction of the rotary piston charger 44 the windows. 54, 55, 56 have a length that is approximately equal to the clearance of the charger outlet openings and, thus, the combustion space inlet openings of the engine cylinder. In the revolving direction of the rotors of the rotary piston charger 44, there is arranged one fuel injection valve 57 for each of the engine cylinders in the peripheral direction at a slight distance behind the charger inlet opening 53. On the outside of the outer rotor casing 46, there is a trough-shaped outlet recess 58 for each of the engine cylinders, extending in the axial direction of the rotary piston charger 44 at least approximately over the entire inner diameter of the corresponding engine cylinder and arranged with a displacement in the peripheral direction with respect to the window 54, 55, 56 of the particular engine cylinder. In addition to the rotary piston charger 44, the cylinder head 52 carries a spark plug 60 for each engine cylinder and, thus, for each combustion space 59. p During operation of the engine 43, the rotary piston charger 44 is actuated by the crank shaft 61. The crank shaft revolves twice as fast as the outer rotor 45 of the charger 44. Fresh air flows onto the side of the charger 44 turned away from the engine cylinders through a fresh air line 62, which has a swiveling control sleeve to adjust the filling, and transverse to the direction of the axis of the rotary piston charger through the windows 54, 55, 56 in the particular inflow position into the corresponding compression chamber 48, which extends over the entire length of the outer rotor 45 without any transverse bulkheads. Upon passing the fuel injection valves 57, fuel is brought into the compression chamber 48 through the corresponding window 54, 55, 56. The fresh gas present in the compression chamber 48 is compressed upon rotation of the rotary piston in this compression chamber 48 and forced out into the compression space 59 of the engine cylinder through a radial charger outlet opening that is provided in the casing wall of the charger housing 51, corresponding to this compression chamber 48 with its window 54, 55, 56. The volume of the compression chambers 48 is adjusted to that of the combustion spaces 59. The outer rotor 45 not only accomplishes the control of the combustion space inlet openings, but also the control of the combustion space outlet openings, formed by the outlet recesses 58, as soon as these travel with their forward-running end across an outlet edge 63 of the cylinder head 52. Through the outlet recesses 58, the burned gases can escape from the combustion spaces 59 into an cutlet channel 64. The outflow connection is closed off by the wall of the outer rotor casing 46, adjoining the backward-running end of the outlet recess 58.

Figure 6:
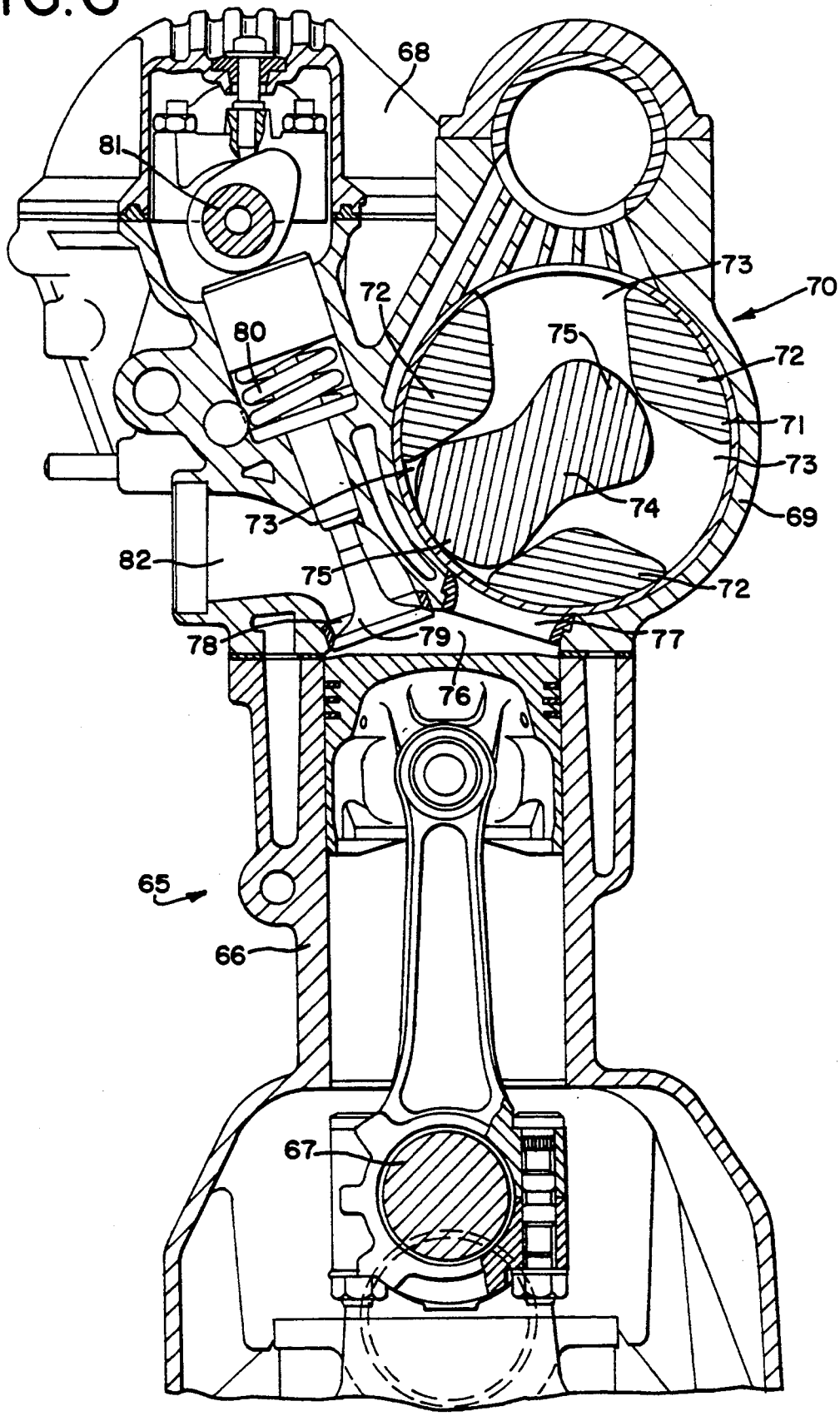

In the embodiment shown in of FIG. 6, a rotary piston charger 70 is provided in a four-stroke internal combustion engine 65 with engine cylinders 66 and a crank shaft 67 in a cylinder head 68, which forms a charger housing 69. The outer rotor 71 of the charger, again, has three engagement pieces 72 arranged uniformly about the periphery and, accordingly, three compression chambers 73 that are equal to each other. An inner rotor 74 with two engagement pieces 75 is arranged in the outer rotor 71, once again being eccentric to it. In the charger housing 69 there are charger outlet openings which emerge into the combustion spaces 76. The combustion space outlet openings 78 can be closed off by outlet valves 79, designed as lifting valve, under the action of valve springs 80. A cam shaft 81 is used to open the outlet valves 79.

During operation of the engine 65, the rotary piston charger 70 is actuated by the crank shaft 67. The ratio between the rotational speed of the crank shaft 67 and that of the outer rotor 71 of the rotary piston charger 70 is 2:1 in the case of an engine with three cylinders, preferably arranged in a row. The rotary piston charger 70 delivers fresh gas to the combustion spaces 76. Ejection of the burned gases is done with the outlet valves 79 opened, through the combustion space outlet openings 78 and outlet channels 82. Several outlet valves, instead of one, may be provided for each of the combustion spaces 76.

Figure 7:
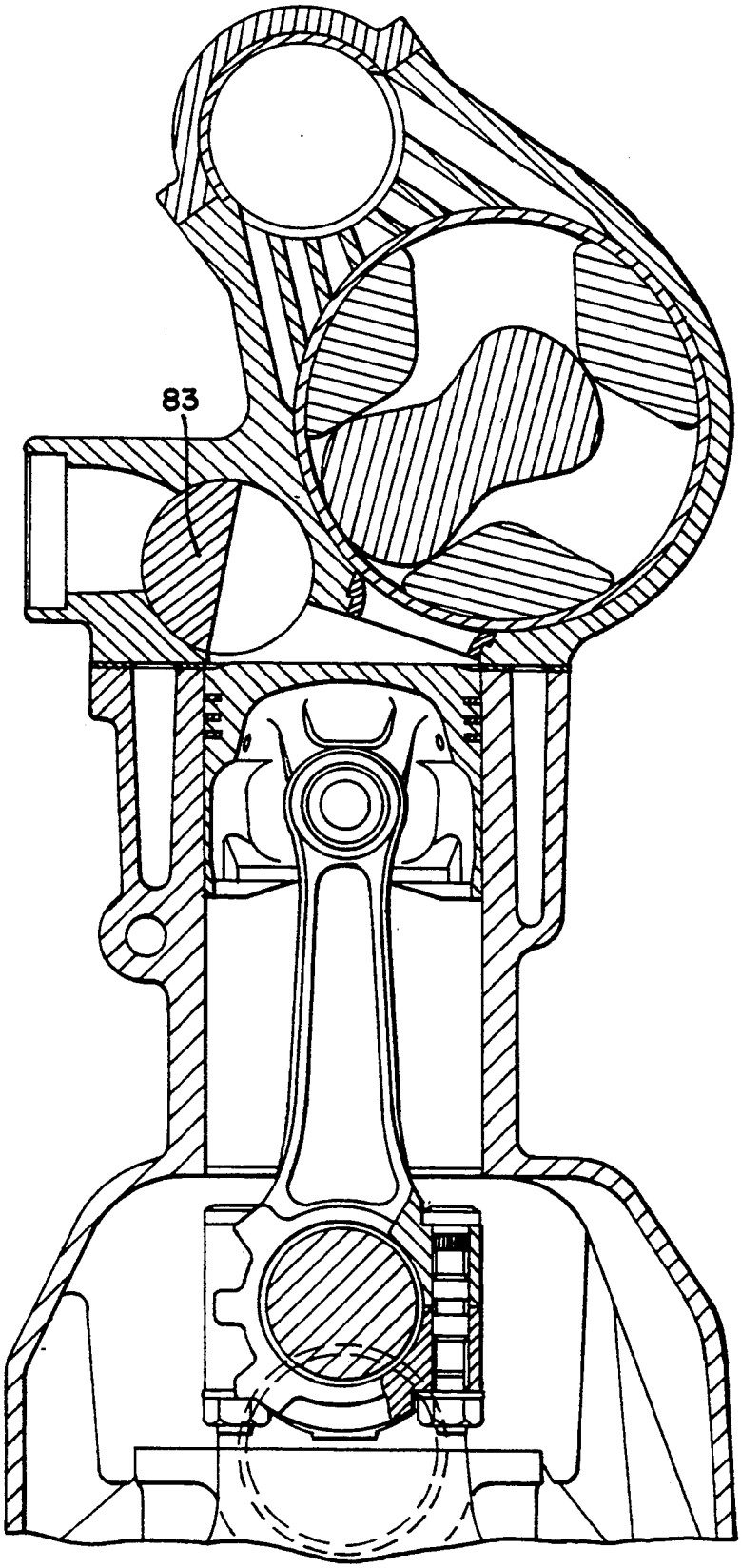

The embodiment shown in FIG. 7 differs from that of FIG. 6 in having a rotary valve 83, instead of the lifting valve, as gas exchange control element for the combustion space outlet.

Figure 8:
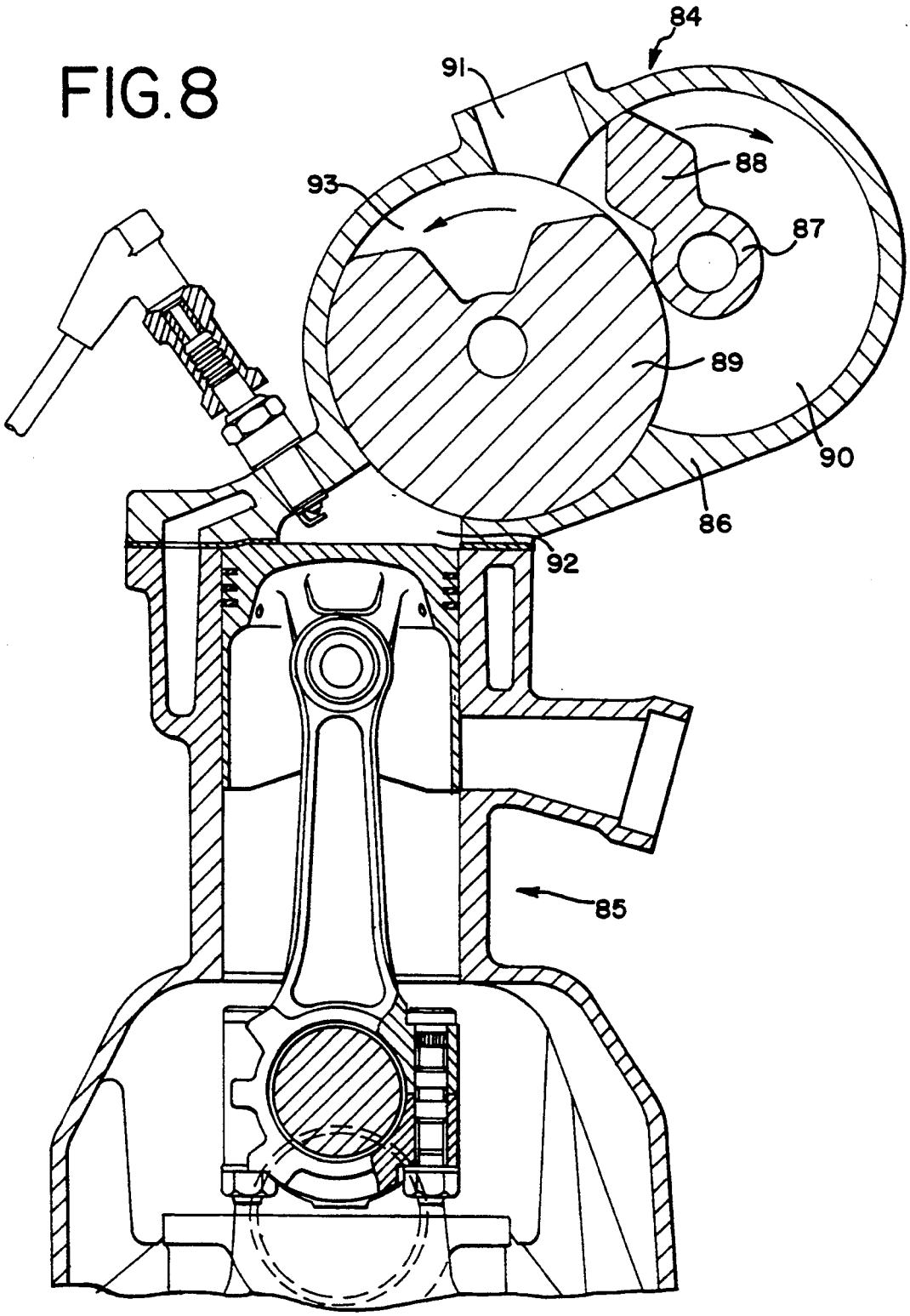

In the embodiment shown in FIG. 8, unlike the preceding embodiments, an outer-axis, not an inner-axis, rotary piston machine, is used as the rotary piston charger 84. This is placed on a two-stroke internal combustion engine 85 and has, in a cylinder head with a charger housing 86 mounted on the engine cylinder housing, a piston rotor 87, with a single piston 88 extending at least approximately in the radial direction and a shutting rotor 89. The piston 88 may rotate in a cylindrical compression chamber 90 with a charger inlet opening 91. A charger outlet opening 92 can be closed off by the shutting rotor 89, which is cylindrically shaped over a wide range of its periphery and extends with its cylindrical wall up to the piston rotor 87. The shutting rotor 89 has a cavity 93 for passage of the piston 88. This cavity 93 at the same time serves to control the charger outlet opening 92, which is also the combustion space inlet opening.

During operation of the internal combustion engine 85, the rotary piston charger 84 is actuated from the crank shaft of the engine 85. The ratio between the rotating speed of the crank shaft and that of the shutting rotor 89 or the oppositely rotating piston rotor 87 of the charger 84 is 1:1. Through the charger inlet opening 91, fresh gas entering into the charger housing 86 is compressed by the piston 88 in the compression chamber 90 and delivered to the charger outlet opening 92, through which it flows into the combustion space as soon as the shutting rotor 89 clears the passageway with its cavity 93.

In a multiple-cylinder engine, several compression chambers may be arranged one behind the other in the axial direction. These may be separated from each other either by fixed walls or by walls that are joined to the rotors and consequently revolve with them.

Instead of a piston rotor with only one piston, it is possible to use a piston rotor with several pistons distributed about the periphery, matched up with a shutting rotor with a corresponding number of cavities. In this case, the transmission between the crank shaft and the rotors should be adjusted to the number of pistons.

Instead of the arrangement of the displacement charger at the cylinder head in the two-stroke internal combustion engines of FIG. 1–3 and 8, an arrangement at the cylinder foot may be provided. In this kind of arrangement, just as in the sample configurations of FIG. 1–3 and 8, a uniflow scavenging can be used to good effect, in which case the combustion space outlet is of course provided at the cylinder head, or a reverse flow scavenging may be provided.

When one rotary piston charger is assigned to one engine cylinder, as occurs in the case of single cylinder engines, but which can also be provided in multiple-cylinder engines, the charger may adjoin the engine cylinder with its casing wall or with one of its end walls. Accordingly, the charger outlet opening should be provided in the casing wall or in the end wall of the charger. In the case of an end-wall connection, the axis of the charger may form an extension of the axis of the engine cylinder, or it can be arranged at least approximately parallel with it.

We claim:

1. An internal combustion engine comprising:

at least one set of three cylinders, each of said cylinders having a combustion space, said combustion space provided with an outlet gap controlled by a stroke piston;

at least one rotary piston charger in constant driving connection with a crank shaft and having:

an outlet opening forming an inlet opening of one of said combustion spaces, said opening capable of being closed off by a gas exchange control element that is separate from the stroke piston;

a charger housing having a first rotor formed as a cylinder and having an outer shell and openings arranged in such shell forming such charger outlet opening and forming said gas exchange control element as a rotary valve and, after completion of a charger exchange, providing a stationary envelope surface of at least one of said combustions spaces, and wherein said charger housing is a part of a head of a cylinder and said first rotor having three engaging pieces evenly spaced within said outer shell;

and a second rotor arranged in the first rotor and engaging said engaging pieces.

* * * * *